US009415521B1

(12) United States Patent
Sliver et al.

(10) Patent No.: US 9,415,521 B1
(45) Date of Patent: Aug. 16, 2016

(54) HANDHELD DRYWALL CUTTER DEVICE

(71) Applicants: Christ Sliver, Baxter, MN (US); Devon Martin, Baxter, MN (US)

(72) Inventors: Christ Sliver, Baxter, MN (US); Devon Martin, Baxter, MN (US)

( * ) Notice: Subject to any disclaimer, the term of this patent is extended or adjusted under 35 U.S.C. 154(b) by 236 days.

(21) Appl. No.: 14/216,081

(22) Filed: Mar. 17, 2014

(51) Int. Cl.
*B26B 5/00* (2006.01)

(52) U.S. Cl.
CPC ..... *B26B 5/005* (2013.01)

(58) Field of Classification Search
CPC ..... B26B 5/00; B26B 5/005; B26B 5/006; B26B 5/007; B26B 27/005
USPC ..... D8/14, 98, 99; 30/2, 278, 280, 287, 30/292–294, 299, 304, DIG. 3, 279.2, 30/279.6
See application file for complete search history.

(56) References Cited

U.S. PATENT DOCUMENTS 421,717 A * 2/1890 Hunt ..... B26B 27/00 30/294
1,031,578 A * 7/1912 Palis ..... B26B 25/00 30/292
1,705,882 A * 3/1929 Springer ..... B26B 27/005 30/293
2,067,986 A * 1/1937 Schmidt ..... B26B 27/005 30/287
2,068,020 A * 1/1937 Grounds ..... B26B 27/005 30/287
2,089,774 A * 8/1937 Wachstein ..... H01B 7/38 30/287
2,187,634 A * 1/1940 Soderlind ..... B43M 7/002 30/DIG. 3
2,233,497 A * 3/1941 Teigen ..... B43M 7/002 30/DIG. 3
2,298,024 A * 10/1942 Vallarelli ..... B43M 7/002 30/DIG. 3
2,647,313 A * 8/1953 Ohlsson ..... B43M 7/005 30/DIG. 3
2,649,656 A * 8/1953 Hedrick ..... B43M 7/002 30/DIG. 3
2,706,002 A * 4/1955 Whittamore ..... B26D 1/245 30/292
2,902,713 A * 9/1959 Buelow ..... E04F 21/32 30/299
3,068,569 A * 12/1962 Campbell, Jr. ..... B43M 7/002 30/DIG. 3

(Continued)

FOREIGN PATENT DOCUMENTS

CA 2461331 A1 * 9/2005
CA 2525755 A1 * 5/2007

(Continued)

*Primary Examiner* — Jason Daniel Prone
(74) *Attorney, Agent, or Firm* — Crossley and Stevenson Intellectual Property Law

(57) ABSTRACT

A handheld drywall cutter device providing self-guiding device for a worker to accurately and single handedly cut a given edge of drywall, quickly, easily, on both sides, straight, and without wavering. By cutting both sides of drywall the device ensures accurate breaks without paper or drywall surface material tears. The device provides for measurement of depth of cut with regard to the drywall. The device can be used with drywall positioned in virtually any way or position without need for clamping or guiding the drywall itself.

9 Claims, 5 Drawing Sheets

(56) References Cited

U.S. PATENT DOCUMENTS 3,118,228 A * 1/1964 Adams ..... B43M 7/002 30/DIG. 3
D203,268 S * 12/1965 Swann, Jr. ..... D8/98
3,383,768 A * 5/1968 Hamilton ..... B43M 7/002 30/287
3,596,356 A * 8/1971 O'Neal ..... B26D 3/065 30/279.6
3,611,571 A * 10/1971 Belling ..... H05K 13/0007 30/280
3,639,983 A * 2/1972 Knipfing ..... B43M 7/00 30/294
3,644,993 A * 2/1972 Chupp ..... B27G 17/025 30/280
4,052,790 A * 10/1977 Carle ..... B26B 27/00 30/287
4,064,626 A * 12/1977 Meshulam ..... B26B 5/005 30/287
4,180,908 A * 1/1980 Beermann ..... B26B 5/005 30/279.6
4,495,697 A * 1/1985 Ruff ..... B26B 5/005 30/287
4,530,154 A * 7/1985 DiCarlo ..... B26B 5/00 30/DIG. 3
4,667,409 A * 5/1987 D'Amato ..... B26B 5/005 30/287
4,711,031 A * 12/1987 Annello ..... B26B 27/00 30/DIG. 3
4,777,724 A * 10/1988 Sirchia ..... B26B 5/005 30/287
5,007,171 A * 4/1991 Horning, Jr. ..... B65B 69/0033 30/DIG. 3
5,044,081 A * 9/1991 Nguyen ..... B26B 5/005 30/289
5,048,188 A * 9/1991 Wolff ..... B26B 27/00 30/289
5,127,161 A * 7/1992 Ikeda ..... B43M 7/002 30/DIG. 3
5,653,031 A * 8/1997 Richter ..... B26B 27/00 30/280
5,666,731 A * 9/1997 Rungren ..... B26B 29/06 30/DIG. 3
5,720,104 A * 2/1998 Decker ..... B26B 29/06 30/293
5,791,048 A * 8/1998 Bodnar ..... B26B 29/02 30/294
D399,402 S * 10/1998 Unruh ..... D8/98
5,848,471 A * 12/1998 Freeland ..... B26D 3/003 30/280
5,946,808 A * 9/1999 Martinez ..... B26B 29/06 30/294
5,992,286 A * 11/1999 Boole ..... B65B 69/0033 30/280
D419,417 S * 1/2000 Kane ..... D8/98
6,029,355 A * 2/2000 Carlin ..... B26D 3/001 30/304
D423,318 S * 4/2000 Lacy ..... D8/98
6,298,561 B1 * 10/2001 Decker ..... B26B 29/06 30/279.2
6,430,817 B2 * 8/2002 Hoffman ..... 30/293
6,625,889 B2 * 9/2003 Belsaas ..... B27D 5/006 30/280
6,745,476 B2 * 6/2004 Korba, Jr. ..... B26B 29/06 30/299
6,941,664 B1 * 9/2005 Engle ..... E04D 15/02 30/287
7,287,329 B2 10/2007 Cornacchio
D558,554 S * 1/2008 Carbonaro ..... D8/98
D714,124 S * 9/2014 Fujino ..... D8/98
2002/0092169 A1 * 7/2002 Kilduff ..... B67B 7/30 30/278
2003/0097758 A1 * 5/2003 Frazier ..... B26B 3/00 30/299
2003/0200663 A1 * 10/2003 Clanton ..... B26B 29/06 30/294
2004/0227022 A1 * 11/2004 Friedenbach ..... B26B 5/00 30/280
2004/0231171 A1 11/2004 Cornacchio
2006/0156553 A1 * 7/2006 Ensenat Alvarez ..... B26B 3/00 30/280
2006/0272159 A1 * 12/2006 Rubin ..... B26B 27/005 30/162
2009/0056149 A1 * 3/2009 Kentrotas ..... B26B 5/00 30/294
2009/0094842 A1 * 4/2009 Yoo ..... B26D 1/245 30/294
2009/0271993 A1 * 11/2009 Semprini ..... B26B 29/06 30/292
2014/0373692 A1 * 12/2014 Zeltner ..... B43M 7/002 30/294

FOREIGN PATENT DOCUMENTS

FR 1123524 A * 9/1956
FR 1507321 A * 12/1967
FR 2165230 A6 * 8/1973

* cited by examiner

HANDHELD DRYWALL CUTTER DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of drywall cutting devices are known in the prior art. However, what is needed is a handheld drywall cutter device that is usable in one hand of a user, quickly and easily, cuts both sides of drywall, is depth adjustable with respect to how far from an edge of drywall to cut, removably carries existing standardized utility cutting blades at an angle to the drywall, negates the simultaneous use of a ruler, negates the need for attaching or clamping existing tools, and offers ergonomic hand grip.

FIELD OF THE INVENTION

The present invention relates to drywall cutting devices, and more particularly, to a handheld drywall cutter device.

SUMMARY OF THE INVENTION

The general purpose of the present handheld drywall cutter device, described subsequently in greater detail, is to provide a handheld drywall cutter device which has many novel features that result in a handheld drywall cutter device which is not anticipated, rendered obvious, suggested, or even implied by prior art, either alone or in combination thereof.

To accomplish this, the present handheld drywall cutter device provides a singly handheld, self-guiding device for a worker to accurately cut a given edge of drywall, quickly, easily, on both sides, straight, and without wavering. The handheld drywall cutter device also solves an old problem in drywall cutting wherein a worker typically either tries to follow a marked line or use some sort of straight edge or ruler with a utility knife. The same worker, after typically cutting one side of the drywall, snaps a desired piece away from the other. Partially cut pieces seldom break along a straight plane, and with most drywall paper covering seldom breaks away correctly, often tearing. These problems are magnified with larger pieces of drywall. Such methods are also extremely time consuming, and one of a drywall workers primary concerns is time. Loss of productivity is money lost to workers, supervisors, and company. Additionally, should a worker have to use a large cutter tool, such as a floor based tool, such tools require extensive space and do not easily allow for quick cutting, aside from the fact that handling an entire sheet of drywall is quite cumbersome. Handling drywall repeatedly is time consuming and tiring. Hand cutting and conveying straight to application or cut at application site is therefore far more desirable.

The present handheld drywall cutter device solves above noted problems. The lightweight handheld drywall cutter device greatly improves upon currently used and proposed devices and methods. The device includes a housing having a top side spaced apart a bottom side, a first end spaced apart from a second end, and a first side spaced apart from a second side. An outward projection can be extended outwardly from each of the first side and the second side as an ergonomic feature. Each outward projection is disposed adjacent to the bottom side, beginning at the second end and continued uninterrupted adjacent to the first end and the top side. An interiorly rounded corner can be disposed in each outward projection as further ergonomic aid. Each rounded corner is disposed proximal each of the first end and the bottom side. A recess can be continuously disposed in each of the first side and the second side. Each recess is extended from an inside of each of the outward projections to the top side and the second end.

A receiving channel is continuously centrally disposed through the housing between the first side and the second side and continuously disposed from the first end to the second end. The receiving channel is open on the bottom side of the housing and closed on the top side of the housing. A first inward side is continuously disposed on the first side. A second inward side is continuously disposed on the second side. The first inward side and the second inward side are parallel to each other. A plurality of equidistantly spaced apart depth slots is continuously disposed within each of the first inward side and the second inward side. The depth slots are parallel with the top side, the first inward side being a mirror image of the second inward side. A depth plate is removably and selectively disposed within a pair of the depth slots in a position parallel to the top side. Depth plate depth slot insertion provides an important, convenient and rapid ease of adjustment in determining the depth of cuts from the edge of drywall, again cutting without wavering.

An angled blade slot is disposed within the bottom side of each of the first side and the second side. Each blade slot is configured to removably receive a utility blade in a position wherein each blade angularly protrudes into the receiving channel. A blade retainer is removably affixed below each blade slot. A pair of spaced apart fasteners is disposed through each of the blade retainers. Fasteners can include but are not limited to screws, thumbscrews, Dzus fasteners, and any appropriate fastening devices. Each fastener is selectively secured within the bottom side of each of the first side and the second side, wherein the fasteners are configured to selectively secure each blade retainer.

Various design features can be used to anchor a blade angularly within each inset. An angular blade attack toward drywall is superior, with a point of a utility blade trailing the attack. A blade slot can be disposed within each inset to aid in blade retention. Each blade slot is thereby in removable receipt of an existing utility blade. Such blades are common to utility knifes and other cutting tools. A blade retainer is selectively disposed atop each inset. The blade retainer can be pivotally positioned atop each inset. Each blade retainer can have a medially disposed squared internal end and even angular internal end for fitting against a matching interior end of featured insets. A rounded end blade retainer can be disposed opposite squared and angular interior ends. Each blade retainer can have a screw slot disposed proximal to the internal end with each screw slot opened toward the receiving channel.

A pair of spaced apart fasteners can be disposed through each of the blade retainers, with each fastener selectively retained within each of the insets. Fasteners can thereby selectively anchor each blade retainer when tightened and further allow pivot of each blade retainer when loosened. Removal of the fasteners of each blade retainer can also allow blade retainer removal.

The device is configured to be used in one hand by a user. The user sets the depth of the cut to be made by using the device without the use of the depth plate and also by inserting the depth plate within the chosen mirror image depth slot pair. By sliding the device along the chosen edge of existing drywall, the drywall is cut on each side, and through the drywall paper, if there. The user then easily snaps the drywall along the opposing cuts and has a clean break line. Drywall can thereby be cut in any chosen location, especially without requiring movement of the drywall to any tool base or stationary tool, as has in the past often been required.

Thus has been broadly outlined the more important features of the present handheld drywall cutter device so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
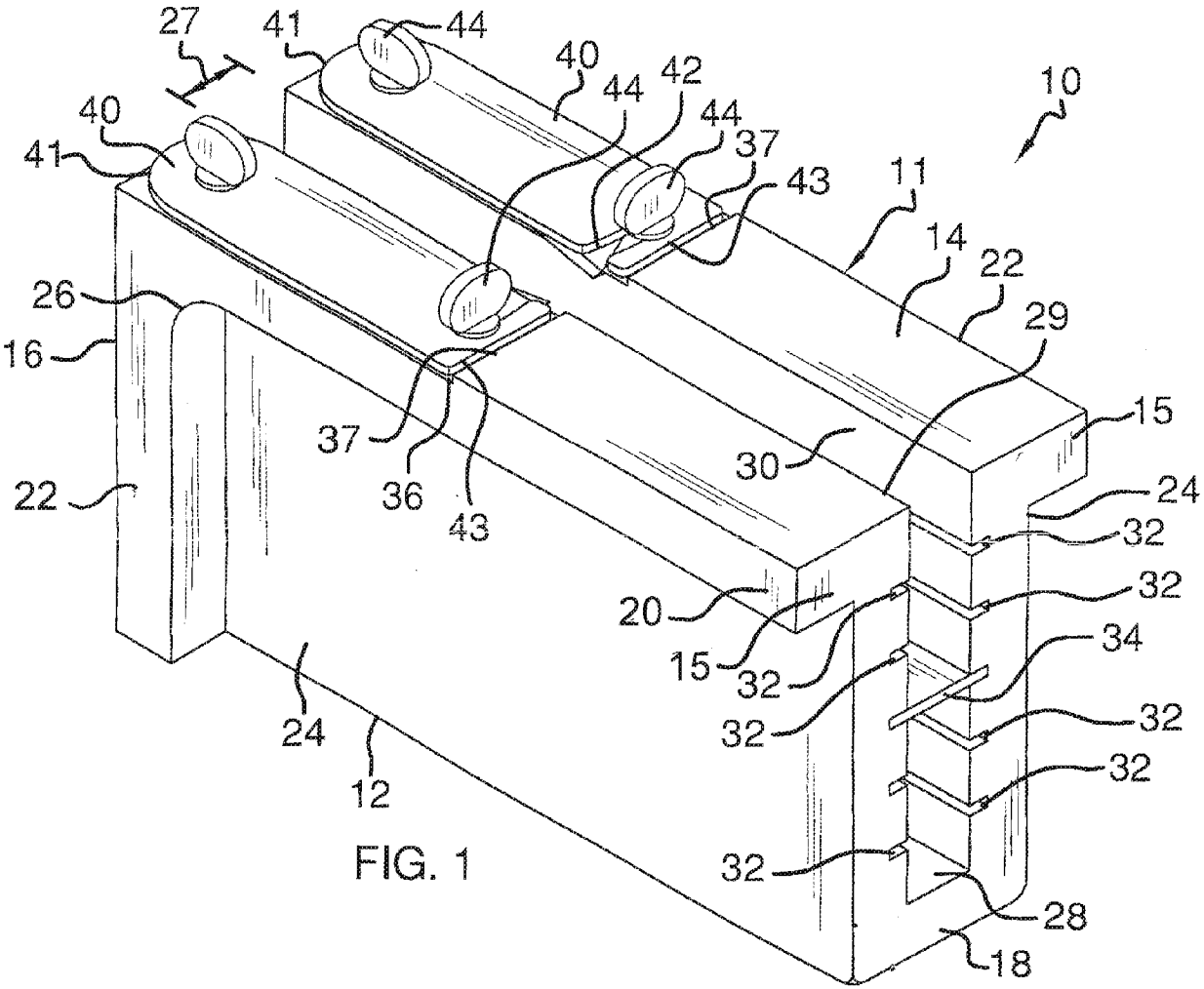
FIG. 1 is a bottom right side second end isometric view.
Figure 2:
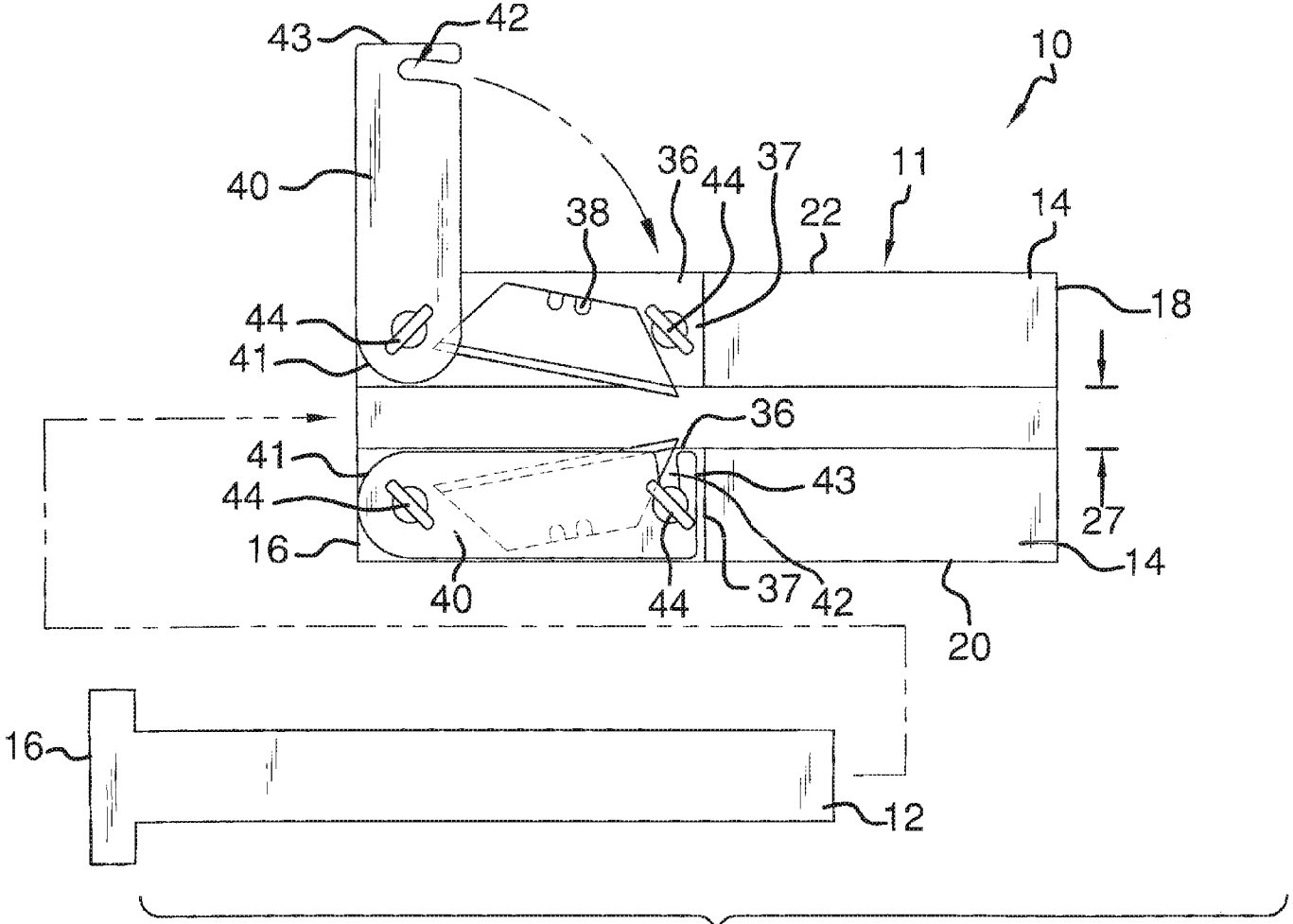
FIG. 2 is an exploded bottom plan view, left side blade retainer pivotally open.
Figure 3:
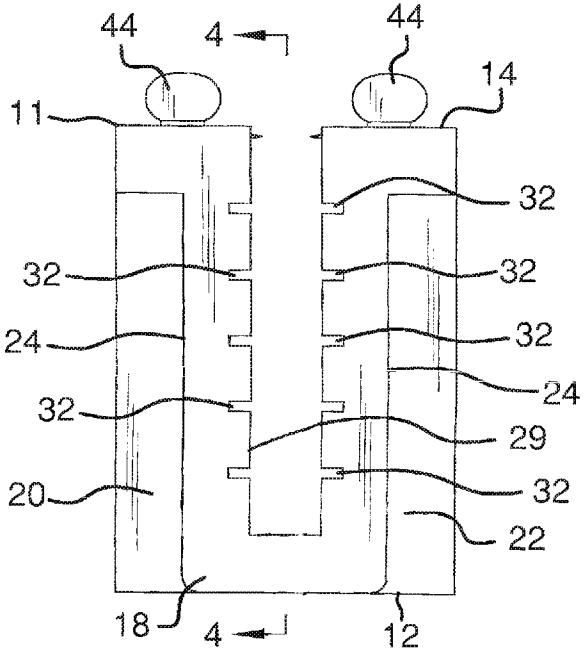
FIG. 3 is a second end elevation view.
Figure 4:
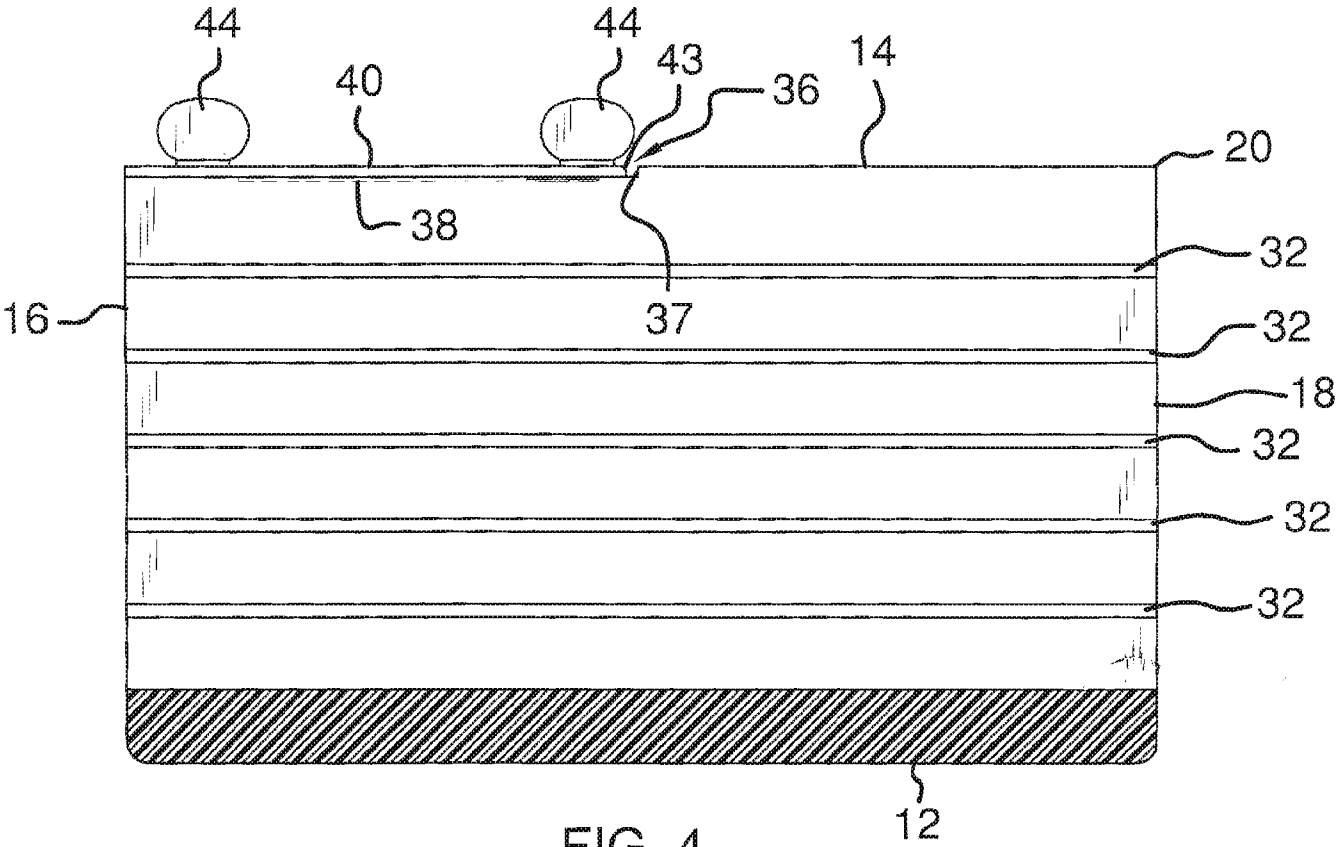
FIG. 4 is a left side cross sectional view taken along the line 4-4 of FIG. 3.
Figure 5:
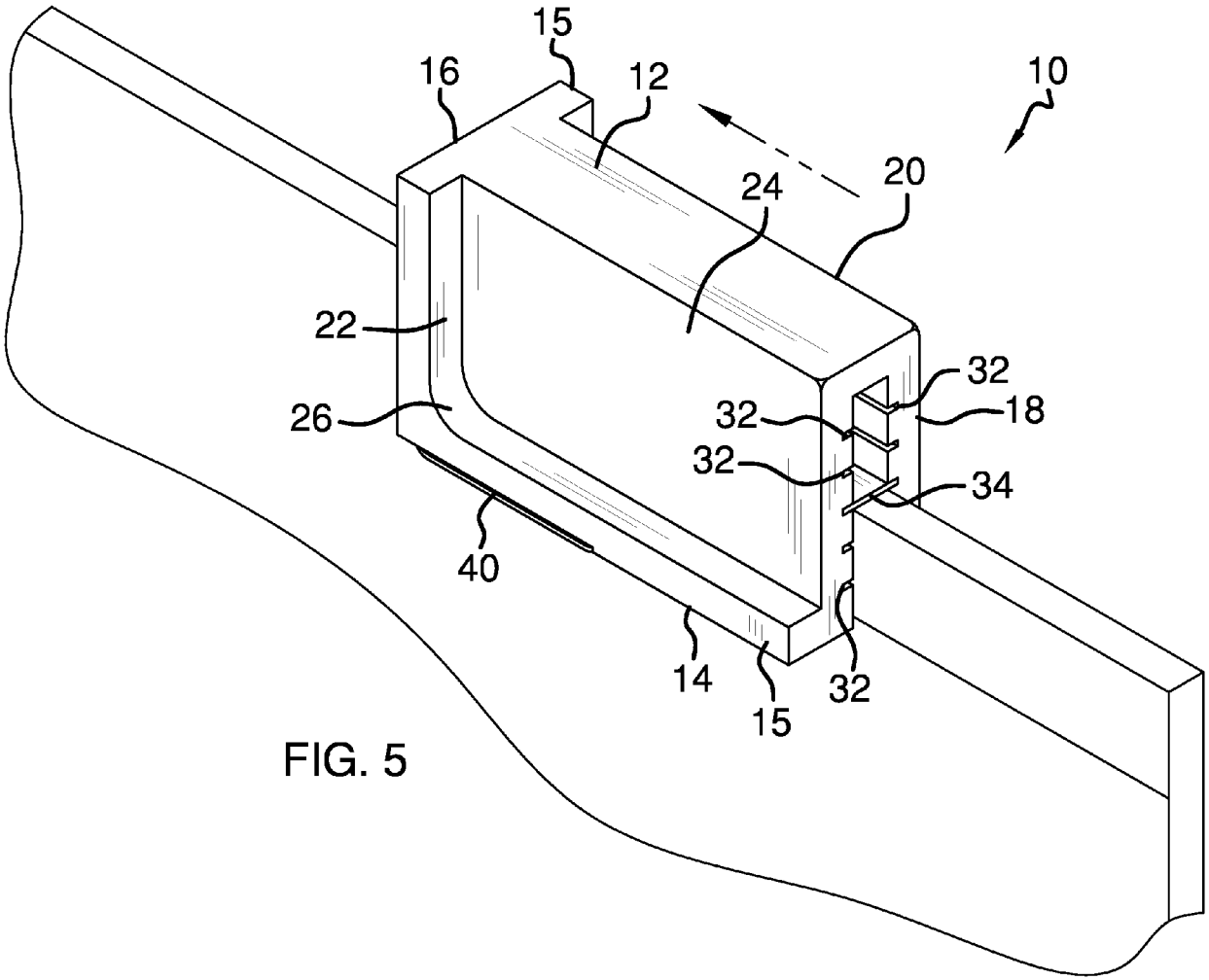
FIG. 5 is a top left side second end isometric in-use view.

With reference now to the drawings, and in particular FIGS. 1 through 5 thereof, an example of the handheld drywall cutter device employing the principles and concepts of the present handheld drywall cutter device and generally designated by the reference number 10 will be described.

Referring to FIGS. 1 through 5, the present handheld drywall cutter device 10 includes a housing 11 having a top side 12 spaced apart a bottom side 14, a first end 16 spaced apart from a second end 18, and a first side 20 spaced apart from a second side 22. An outward projection 15 is extended outwardly from each of the first side 20 and the second side 22. Each outward projection 15 is disposed adjacent to the bottom side 14, beginning at the second end 18 and continued uninterrupted adjacent to the first end 16 and the top side 12. A rounded interior corner 26 is disposed in each outward projection 15. Each rounded interior corner 26 is disposed proximal each of the first end 16 and the bottom side 14. A recess 24 is continuously disposed in each of the first side 20 and the second side 22. Each recess 24 is extended from an inside of each of the outward projections 15 to the top side 12 and the second end 18.

A receiving channel 27 is continuously centrally disposed between the first side 20 and the second side 22 and continuously disposed from the first end 16 to the second end 18. The receiving channel 27 is open on the bottom side 14 of the housing 11 and closed on the top side 12 of the housing 11. A first inward side 29 is continuously disposed from the first end 16 to the second end 18 on the first side 20. A second inward side 30 is continuously disposed from the first end 16 to the second end 18 on the second side 22. The first inward side 29 and the second inward side 30 are parallel to each other.

A plurality of equidistantly spaced apart depth slots 32 is continuously disposed within each of the first inward side 29 and the second inward side 30. The depth slots 32 are parallel with the top side 12, the first inward side 29 being a mirror image of the second inward side 30. A depth plate 34 is removably and selectively disposed within a pair of the depth slots 32 in a position parallel to the top side 12.

An inset 36 is disposed within each of the bottom side 14 of the first side 20 and the second side 22. An angled blade slot 38 is disposed within each inset 36. Each blade slot 38 is configured to removably receive a utility blade in a position wherein each blade angularly protrudes into the receiving channel 27. A blade retainer 40 is removably affixed in covering each blade slot 38, thereby selectively retaining each blade. A pair of spaced apart fasteners 44 is disposed through each of the blade retainers 40. Each respective fastener 44 is selectively secured within each inset 36, wherein the fasteners 44 are configured to selectively secure each blade retainer 40, and wherein the housing 11 is configured to be used single-handedly. A rounded end 41 is disposed on each blade retainer 40 opposite each internal end 43.

Each blade retainer 40 has an internal end 43 disposed within each inset 36. Each internal end 43 is squared. Each inset 36 interior end 37 is squared. Each interior end 37 matches each internal end 43 wherein each internal end 43 is selectively positioned proximal to each inset 36 interior end 37 to further ensure selected blade retention as desired. A screw slot 42 is disposed proximal to the internal end 43 of each blade retainer 40. The drywall is cut by placing the device on a chosen drywall edge and sliding along that edge, wherein straight, unwavering cuts are executed on each side of the drywall.

What is claimed is:

1. A handheld drywall cutter device comprising:

a housing having a top side spaced apart a bottom side, a first end spaced apart from a second end, and a first side spaced apart from a second side;

a receiving channel continuously centrally disposed through the housing between the first side and the second side and continuously disposed from the first end to the second end, the receiving channel being open on the bottom side of the housing and closed on the top side of the housing;

a first inward side continuously disposed on the first side;

a second inward side continuously disposed on the second side, the first inward side and the second inward side parallel to each other;

a plurality of equidistantly spaced apart depth slots continuously disposed within each of the first inward side and the second inward side, the depth slots parallel with the top side of the housing, the first inward side being a mirror image of the second inward side;

a depth plate removably and selectively disposed within a pair of the depth slots in a position parallel to the top side;

an angled blade slot disposed within the bottom side of each of the first side and the second side;

at least one utility blade, each of the blade slots configured to removably receive the at least one utility blade in a position wherein the at least one utility blade angularly protrudes into the receiving channel;

a blade retainer removably affixed in covering each blade slot; and a pair of spaced apart fasteners disposed respectively through each of the blade retainers, each of the fasteners selectively secured within the bottom side of a respective one of the first side and the second side;

wherein each of the pair of spaced apart fasteners is configured to selectively secure the respective one of the blade retainers to the bottom side of the housing.

2. The device of claim 1 further comprising an inset disposed adjacent to the first end and the bottom side, wherein each of the insets have an interior end;

wherein one of the blade slots is further respectively recessed into each of the insets; and wherein each of the blade retainers is removably received within a respective one of the insets.

3. The device of claim 2 wherein each of the blade retainers has an internal end disposed within a respective one of the insets;

wherein the internal end is squared;

wherein the interior end of the respective inset is squared, each of the interior ends matching a respective one of the internal ends; and wherein each of the internal ends matching a respective one of the inset interior ends.

4. The device of claim 2 wherein each of the blade retainers further comprises a screw slot disposed proximal to the internal end thereof.

5. The device of claim 3 wherein each of the blade retainers further comprises a screw slot disposed proximal to the internal end thereof.

6. A handheld drywall cutter device comprising:

a housing having a top side spaced apart a bottom side, a first end spaced apart from a second end, and a first side spaced apart from a second side;

an outward projection extended outwardly from each of the first side and the second side, each of the outward projections is disposed adjacent to the bottom side, beginning at the second end and continued uninterrupted adjacent to the first end and the top side;

a rounded interior corner disposed in each of the projections, each of the rounded corners is disposed proximal to each of the first end and the bottom side;

a recess continuously disposed in the each of the first side and the second side, each of the recesses extend from an inside of a respective one of the outward projections to the top side and the second end;

a receiving channel continuously centrally disposed through the housing between the first side and the second side and continuously disposed from the first end to the second end, the receiving channel being open on the bottom side of the housing and closed on the top side of the housing;

a first inward side continuously disposed on the first side;

a second inward side continuously disposed on the second side, the first inward side and the second inward side parallel;

a plurality of equidistantly spaced apart depth slots continuously disposed within each of the first inward side and the second inward side, the depth slots parallel with the top side of the housing, the first inward side a mirror image of the second inward side;

a depth plate removably and selectively disposed within a pair of the depth slots in a position parallel to the top side;

an inset disposed within the bottom side and each of the first side and the second side, each of the insets is adjacent to the first end;

an angled blade slot respectively disposed within each of the insets;

at least one utility blade, each of the blade slots configured to removably receive the at least one utility blade in an angular protrusion into the receiving channel;

a blade retainer removably affixed in a respective one of the insets; and a pair of spaced apart fasteners disposed respectively through each of the blade retainer, each of the fasteners selectively secured within a respective one of the insets;

wherein each of the pair of spaced apart fasteners is configured to selectively secure the respective one of the blade retainers to the bottom side of the housing.

7. The device of claim 6 wherein the blade retainer has a squared internal end disposed within the respective one of the insets; and wherein the interior end of the respective inset is squared, each of the interior ends matching a respective one of the internal ends; and wherein each of the internal ends matching a respective one of the inset interior ends.

8. The device of claim 6 wherein each of the blade retainers further comprises a screw slot disposed proximal to the internal end thereof.

9. The device of claim 7 wherein each of the blade retainers further comprises a screw slot disposed proximal to the internal end thereof.

* * * * *